United States Patent [19]

Bornsztein

[11] 4,186,757

[45] Feb. 5, 1980

[54] PROCESS FOR FORMING A LARGE SHEET OF NATURAL TOBACCO FOR MANUFACTURING PARTICULARLY CIGAR WRAPPERS

[75] Inventor: René Bornsztein, Antony, France

[73] Assignee: Service d'Exploitation Industrielle des Tabacs et des Allumettes, Paris, France

[21] Appl. No.: 825,385

[22] Filed: Aug. 17, 1977

[30] Foreign Application Priority Data

Aug. 20, 1976 [FR] France ..... 76 25344

[51] Int. Cl.[2] ..... A24B 3/00

[52] U.S. Cl. ..... 131/149; 131/15 R

[58] Field of Search ..... 131/149, 148, 125, 124, 131/15 R, 140 R, 156, 140 L

[56] References Cited

U.S. PATENT DOCUMENTS

| | | | |
|---|---|---|---|
| 2,378,953 | 6/1945 | Rundell | 131/149 |
| 3,744,498 | 7/1973 | Imbert | 131/149 |

*Primary Examiner*—V. Millin

*Attorney, Agent, or Firm*—Holman & Stern

[57] ABSTRACT

A process for forming a large sheet of natural tobacco for manufacturing particularly cigar wrappers comprising the steps of placing end to end natural tobacco leaves or half-leaves with the main rib of said leaves being in alignment for forming a sheet of at least two continuous rows, displacing said rows in such manner that the leaves or half-leaves of a row overlap the leaves or half-leaves of at least another row via their complementary parts and eventually covering with leaf fragments the areas of the tobacco sheet which are deprived of tobacco.

11 Claims, 3 Drawing Figures

PROCESS FOR FORMING A LARGE SHEET OF NATURAL TOBACCO FOR MANUFACTURING PARTICULARLY CIGAR WRAPPERS

The present invention relates to a process for forming a large sheet of natural tobacco for manufacturing particularly cigar wrappers.

It is already known since long how to make reserves of tobacco leaves; generally straps of determined length are cut in the tobacco leaves, which are put side to side and wrapped on bobbins. The tobacco straps made in this way are relatively narrow and therefore fragile, and their width is adapted to a precise use: it is therefore necessary to foresee the reserve of tobacco lines not only in relation with the quantity of manufactured product, but also with the different modes of manufacture.

It is also known to arrange the leaves in a row; to cut in each leaf on either side of the rib trapezoidal fragments of a given height, and angles at the base of a given value; and to displace thereafter said trapezoidal fragments in such manner that their junction is perfect. This solution has the following advantage: whatever the dimension differences between the leaves, the trapezoidal fragments are cut in such manner that they are perfectly connected to each other. But an important mass of rejects is produced, which is not very advantageous when the tobacco used is relatively costly. On the other hand, the leaves arranged in one or more rows are not joined and it is necessary to bring together, in order to form a continuous line of tobacco, not tobacco rows (or leaf fragments) one in relation to other, but each of the leaves of left fragments themselves: mechanization of the process is therefore more difficult.

The process according to the invention departs basically from the hereabove mentioned processes. It is characterized in that at least two continuous rows of tobaccco leaves or half-leaves are arranged which are placed end to end in alignment with their main rib, said continuous rows are displaced in such manner that the leaves or half-leaves of a row overlap the leaves or half-leaves of at least another row via their complementary parts and the areas of the tobacco sheet which are deprived of tobacco are eventually covered with leaf fragments.

This process provides not only a line but also a tobacco sheet the width of which is as required: sheets with a smaller or larger width according to needs may be obtained by forming more or less continuous lines of tobacco leaves or half-leaves.

This process provides also an advanced mechanization in the manufacture of such a product: it is in fact easier to displace and adjust to each other continuous lines of joined leaves (or leaf fragments) rather than separately each leaf or leaf fragment.

This large width of the tobacco sheet provides the latter with a great resistance and allows a full choice of further uses: for instance, several lines of tobacco of determined width may be cut longitudinally prior to their manufacture: or leaf fragments of determined shape or shapes may be cut in the most favourable areas.

According therefore to the general feature of the process according to the invention, there is first formed several continuous lines of tobacco leaves or half-leaves: they are placed end to end in alignment with their main rib. The expression "main rib" is to be understood in a very wide sense: it corresponds, with leaves or half-leaves which would be at least partly stripped, to the side substantially rectilineal and previously adjacent the central rib. Then the process consists in displacing said continuous lines in such manner that the leaves overlap each other via their complementary parts: the convex side of a leaf or half-leaf will correspond to the concave side formed by the ends of two adjacent leaves, as well as a rectilineal side will have to correspond to another rectilineal side. The tobacco sheet is then in principle definitely formed. Such a result is obtained all the better since the leaves or half-leaves used are of substantially equal dimensions. Finally, if there remains between the leaves or half-leaves intervals where tobacco is missing, it is foreseen to cover such intervals with leaf fragments: the latter could be for instance rejects from another manufacturing method.

According to the invention, it is therefore provided to use either entire leaves or half-leaves. The choice will be made in consideration of the criterion or criteria which will be considered as essential: simplicity, quickness of the manufacturing process, strength of the sheet, "beauty" of the sheet, etc.

The choice will also depend on the raw material which is available: the dimensions of the leaves as well as the importance of their ribs will have to be taken in consideration in particular. So, in the "entire leaves" modality, small leaves will be preferably used, with ribs of little importance.

According to the "entire leaves" modality, it will be possible to proceed in particular in the following manner: two continuous lines of leaves may be formed, placed substantially parallel to each other, then to displace longitudinally and transversely a line in relation to the other in such manner that each side of a leaf corresponds to a complementary side of an adjacent leaf.

It is also possible to proceed in the following manner: two continuous rows of entire leaves at least are formed, with the ribs situated on the same side of a plane and the main ribs of which form the longitudinal axis of said rows, said rows are then placed in such manner that they are parallel between themselves and that the areas with a larger width of said rows also correspond between themselves, and the intervals between leaves where tobacco is missing are covered with entire leaves which form therefore a third continuous row of leaves. This solution is particularly advantageous when the leaves have substantially equal dimensions: each of the intervals remaining between two continuous lines corresponds substantially to the dimension of a leaf. It allows in fact a more advanced automatism in the manufacture of the tobacco sheet.

The leaves of a tobacco sheet may be placed indifferently top against bottom or top against top. But the invention foresees to place preferably the leaves of each continuous row in such manner that each end of the bottom of a leaf is adjacent the top of the following or preceeding leaf. More advantageously still, it is foreseen to orientate in the same direction all the leaves forming the tobacco sheet. The secondary ribs of the leaves are then, if not parallel between themselves, at least substantially orientated in the same direction.

The leaves forming the tobacco sheet may not have been stripped of their ribs, at least partly: what the sheet looses in "perfection", the process gains in rapidity and simplicity.

But it is also possible to foresee to previously cut each leaf on either side of the central rib, along a length which is inferior to that of the total rib and corresponds substantially to the critical part of said central rib, then to eliminate said critical part of the central rib. It is enough in fact to remove the part of the central rib which is undesirable or even embarrassing. This allows on the other hand to preserve the unity of each leaf, which facilitates handling.

In this case, it is then foreseen to bring together the parts of each leaf in such manner that the edges previously adjacent the critical part of the central rib are at least joined. One may for instance somewhat stretch two edges of the leaf by using its elasticity.

According to a further modality of the process according to the invention, half-leaves are used for forming the tobacco sheet.

Two continuous rows of half-leaves are at least formed, previously stripped and arranged in such a manner that the rectilineal side previously adjacent the central rib of the half-leaves corresponds substantially to the longitudinal axis of the row, the half-leaves of the same row being arranged top against bottom, and the relief of the secondary ribs is on the same side of a plane: then, the rows are displaced in such manner that the half-leaves overlap each other; and the sheet areas where the tobacco would eventually be missing are covered with sheet fragments. Thus, the secondary ribs of the half-leaves of one same continuous line or row are orientated in the same direction. And in order that this orientation be the same for all the lines, it is also foreseen to reverse, from one line to the next, the top against bottom arrangement of the half-leaves.

Whatever the modality for forming the used sheet, it is foreseen to place the tobacco leaves or leaf fragments in such manner that they are at least adjoining each other. And for maintaining in their respective arrangement all the elements forming the tobacco sheet, one or more known means may be used, such as suction, gluing, partial overlapping of the elements forming the tobacco sheet.

The following description made with reference with the accompanying drawing concerns only some non limitative examples of the invention:

Figure 2:
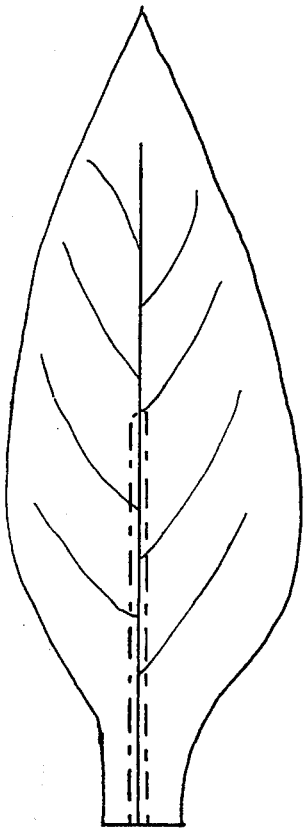
FIG. 2 shows an entire leaf partly stripped.
Figure 1:
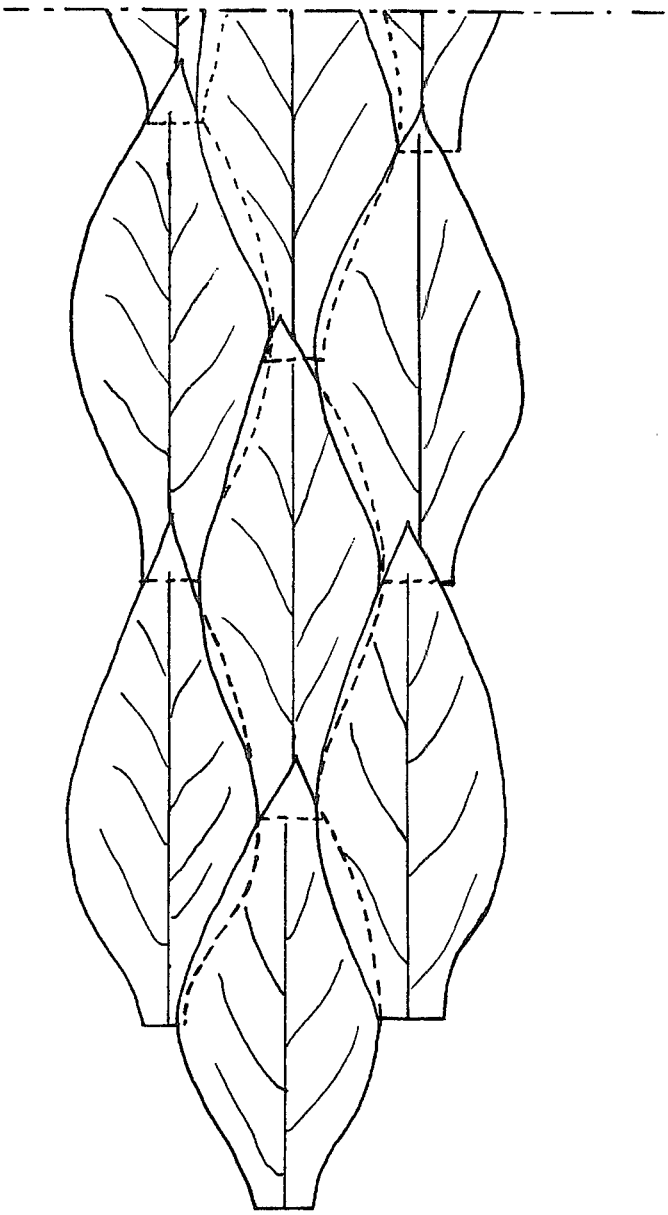
FIGS. 1 and 3 illustrate two modalities for forming the tobacco sheet.

In the case of FIG. 1, the entire leaves are overlapping each other, each convex part of a leaf being inserted in the concave contour formed by the ends of the two other leaves. All the leaves are orientated in the same direction so that the same applies to the secondary ribs of the leaves. The entire leaves are not stripped. But it is also possible to conceive the same arrangement of the leaves while the critical part of the central rib of said leaves has been removed, as is shown in FIG. 2.

Figure 3:
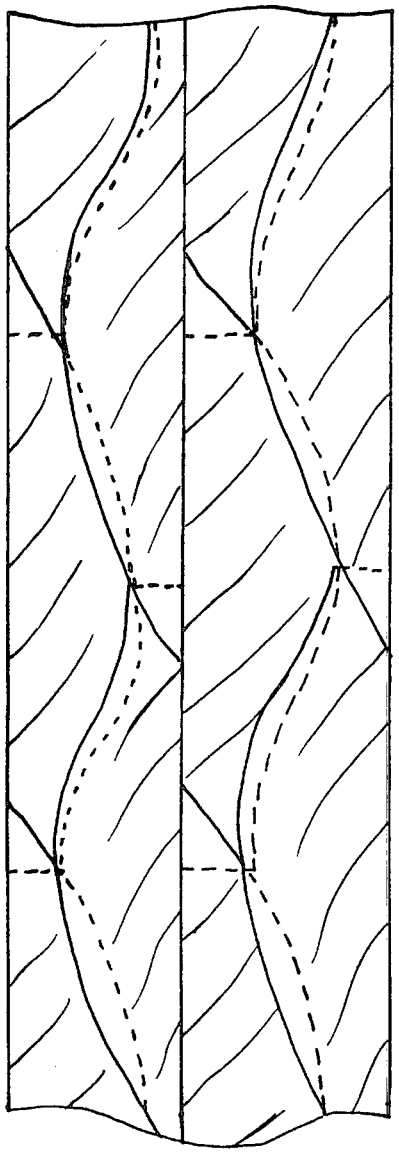

In the case of FIG. 3, the half-leaves of each continuous line are arranged end to end and their rectilineal side, previously adjacent the central rib, corresponds to the longitudinal axis of the line. The expression "axis" refers not to a symmetry axis but to a direction. The half-leaves of the same line are top against bottom so that the secondary ribs are orientated in the same direction. This top against bottom arrangement of the half-leaves is reversed from one line to the next, so that all the secondary ribs of the half-leaves of the tobacco sheet are substantially parallel between themselves. The half-leaves are arranged in such manner that each side of a half-leaf is at least adjacent the complementary side formed by one or more half-leaves.

What I claim is:

1. A process for forming a sheet of natural tobacco from tobacco leaf portions each having a main rib and secondary ribs, the method comprising forming at least two substantially parallel rows of said leaf portions by positioning leaf portions for each row in end to end engagement with the main ribs of the leaf portions extending lengthwise of the respective rows and positioning the rows such that parts of the leaf portions of one row overlapp complementary parts of the leaf portions of an adjacent row and securing said overlapping complementary parts to each other to form said sheet.

2. The process of claim 1 including covering areas of the sheet which are deprived of tobacco with leaf fragments.

3. The process of claim 1 wherein said leaf portions comprise entire tobacco leaves.

4. The process of claim 1 wherein said leaf portions comprise half-leaves.

5. The process of claim 1 wherein the leaf portions each have a bulge intermediate the ends thereof and the adjacent rows are relatively displaced lengthwise whereby the bulges in the leaf portions of one row overlap non-bulging sections of pairs of adjacent leaf portions in the adjacent row.

6. The process of claim 1 wherein said leaf portions comprise entire tobacco leaves and said process includes forming a pair of spaced parallel rows of leaves in which the individual leaves are substantially aligned lengthwise as between the rows and a third row between the spaced rows with the leaves of the third row being displaced lengthwise to the leaves in said spaced rows and with the edges of the leaves of said third row covering the edges of the leaves of each of the spaced rows in overlapping relation complementary to the shape of the leaves.

7. The process of claim 1 including arranging the leaf portions in one row such that their secondary ribs are oriented in the same direction lengthwise of the row.

8. The process of claim 7 including arranging leaf portions in said one row such that their secondary ribs are oriented in the same direction as the secondary ribs of the leaf portions in an adjacent row.

9. The process of claim 7 including arranging the leaf portions in said one row such that their secondary ribs are oriented in the opposite direction to the secondary ribs of the leaf portions in an adjacent row.

10. The process of claim 7 wherein said leaf portions comprise half-leaves and the process includes arranging the half-leaves in adjacent rows in staggered relation lengthwise of the rows whereby the edges of the half-leaves of one row cover the edges of the half-leaves of an adjacent row in overlapping relation complementary to the shape of the half-leaves.

11. The process of claim 10 including arranging the half-leaves in adjacent rows in opposite lengthwise directions respectively.

* * * * *